United States Patent [19]

Eberline

[11] Patent Number: 4,545,318

[45] Date of Patent: Oct. 8, 1985

[54] ANCHOR CONSTRUCTION

[76] Inventor: William C. Eberline, 6378 Garfield, Cass City, Mich. 48726

[21] Appl. No.: 582,127

[22] Filed: Feb. 21, 1984

[51] Int. Cl.[4] ..... B63B 21/36

[52] U.S. Cl. ..... 114/299; 114/306

[58] Field of Search ..... 114/301, 304, 306, 308, 114/310, 299

[56] References Cited

U.S. PATENT DOCUMENTS

| | | | |
|---|---|---|---|
| 2,468,077 | 4/1949 | Kellum | 114/299 |
| 2,612,131 | 9/1952 | Benedict | 114/299 |
| 2,894,474 | 7/1959 | Donaldson | 114/299 |

*Primary Examiner*—Trygve M. Blix
*Assistant Examiner*—C. T. Bartz
*Attorney, Agent, or Firm*—Barnes, Kisselle, Raisch, Choate, Whittemore & Hulbert

[57] ABSTRACT

An anchor construction for fishing and pleasure craft, especially those with a power anchor line winch, which includes a center swivel plate in a plane transverse to an anchor blade. The centerplate has a V-slot in which slides a clevis attached to an anchor line to effect release of a snagged anchor without moving the boat over or past the anchor. A stop lobe on the anchor blade cooperates with the center plate to limit relative motion.

3 Claims, 6 Drawing Figures

ANCHOR CONSTRUCTION

FIELD OF INVENTION

Anchors which are particularly useful with recreational fishing boats and pleasure craft, and more particularly anchors with a sliding shackle.

BACKGROUND OF THE INVENTION

Boat anchors of various types have been known since antiquity and man has constantly sought to improve the efficiency of anchors and to make them more practical. A major advance in the art took place when the Danforth anchor came into being. The Danforth anchor has the flukes pivoted in relation to the shank and may also include crown elements or plates positioned rigidly on the fluke structure. The Danforth anchor, as well as others of the same general type, can be made much lighter than traditional types while still maintaining deep penetrating ability due to the construction and geometry of the anchor. Anchors of the Danforth type have found great utility in connection with smaller boats used for fishing and/or recreation.

A recognized attribute of all pivoted fluke anchors and particularly those possessing crown elements is that the anchors are non-fouling in comparison to rigid traditional types and much more easily retrievable when fouled on the bottom. The development of loop or pocket shanks has increased the retrivability of pivoted fluke anchors still further in the recent prior art.

Prior U.S. patents of interest include the following:

U.S. Pat. No. 2,651,277 (1953) Jenshak
U.S. Pat. No. 2,722,191 (1955) Johnson
U.S. Pat. No. 3,263,642 (1966) Wilson
U.S. Pat. No. 4,210,092 (1980) Battersby An object and feature of the present invention is the provision of a sliding shackle anchor which will respond to the pull on an anchor line in a manner to free the anchor blade from overlying obstructions in a quick response. When a power winch is utilized for an anchor, it is extremely important that the anchor release quickly. Otherwise, the power winch can act to pull the boat down into the water and possibly capsize the craft. When utilizing a power winch or hand crank to reel in the anchor cable, a tension develops which tends to pull the boat down, especially when the anchor is fouled on the bottom by a rock or a root or other obstruction. Under these conditions, the boat is generally downwind from the anchor and a wave hitting the prow of the boat will put a sharp and sudden load on the cable and the anchor. This very often will snap the cable or break the anchor itself or the fastening links.

Thus, it is an object and feature of the invention that, as the anchor cable is reeled in, the cable connection to the anchor will move into a self-releasing position before the boat gets directly above or crosses over the anchor. The anchor is lightweight but designed to grab into the bottom of the body of water.

It is, therefore, an object of the invention to provide an anchor construction which is sturdy and disposed to grab the lake bottom readily but also to function for quick release.

Other objects and features of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as:

FIG. 4, a view similar to FIG. 1 with the anchor line being reeled in.

DETAILED DESCRIPTION OF THE INVENTION AND THE MANNER AND PROCESS OF USING IT

Figure 1:
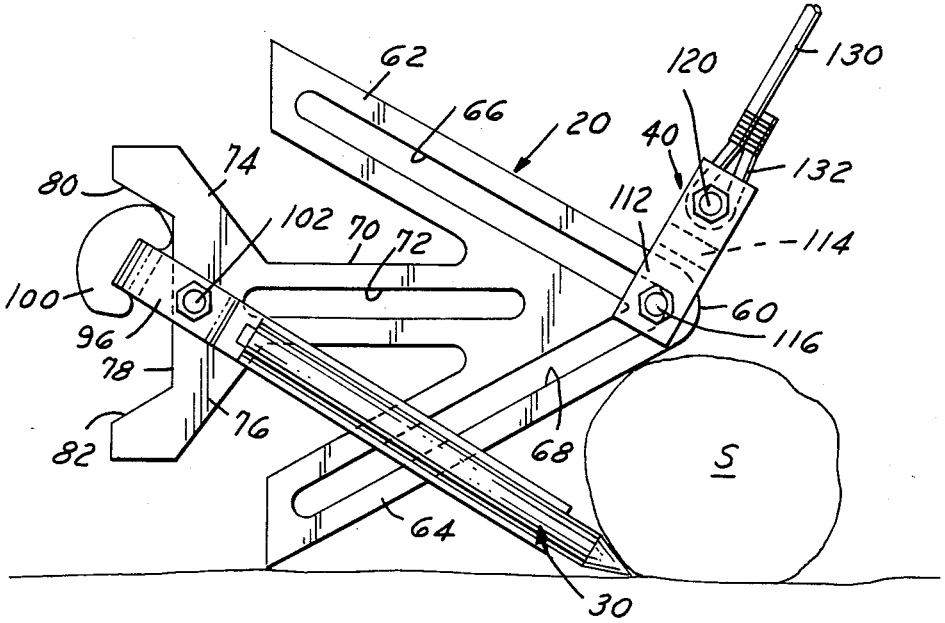
FIG. 1, a side view of the anchor construction.
Figure 2:
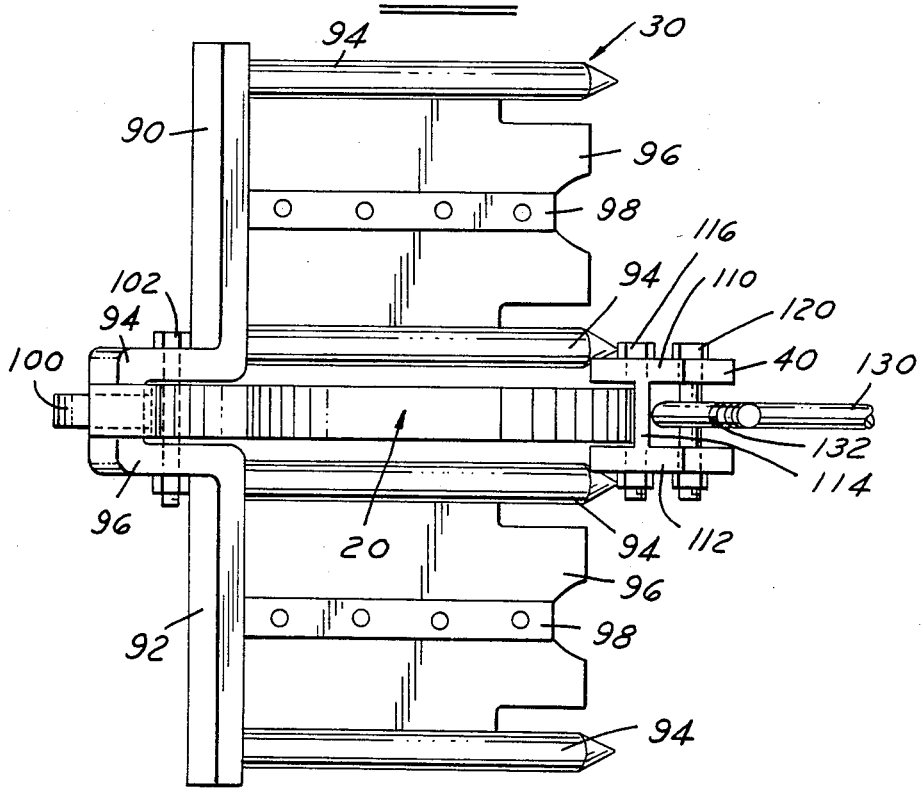
FIG. 2, a plan view of the anchor.

With reference to FIGS. 1 and 2, the anchor construction consists of three basic parts. First is a center plate shown generally at 20; second is a blade 30; third is a slide member preferably in the form of a clevis 40.

The center plate is shaped somewhat like a stubby arrow. From a forward point 60, two wings 62 and 64 extend rearwardly each at about 30° to the axis of the arrow. These wings each have slots 66 and 68 which merge at the nose portion 60. The central shaft portion 70 has a non-functional slot 72 which serves to lighten the anchor and save material. The shaft portion terminates in diverging tail portions 74 and 76 which are shaped to form a rearwardly open recess 78 which, at each end, has angled stop extensions 80 and 82.

The blade 30 has L-shaped top bars 90 and 92 each of which terminates centrally on each side of the center plates 20 in rearwardly extending legs 94 and 96 carrying between them a stop lobe 100 which will cooperate with the stop extensions 80 and 82. The legs 94, 96 are transfixed by a pivot bolt 102 which passes through the center plate between tail portions 74, 76.

Fastened securely to the top bars 90, 92 on either side of the center plate 20 are anchor blades formed of spikes 94 connected by plates 96 with reinforcing strips 98. Thus, it will be seen that the blade 30 is pivoted for free movement about the pivot bolt 102 limited, of course, by the stop lobe and the stop extensions 80, 82.

The shackle clevis 40 is formed by two spaced plates 110, 112 connected by an integral web 114 which lies fairly close to the outside edges of the center plate with sufficient clearance to permit free movement. A traveling bolt 116 transfixes the plates 110, 112 at one end and passes through the merging slots 66, 68. At the other end of the clevis is a bolt 120 between plates 110, 112. A cable or line 130 has a closed loop 132 around the bolt 120.

THE OPERATION

Figure 3:
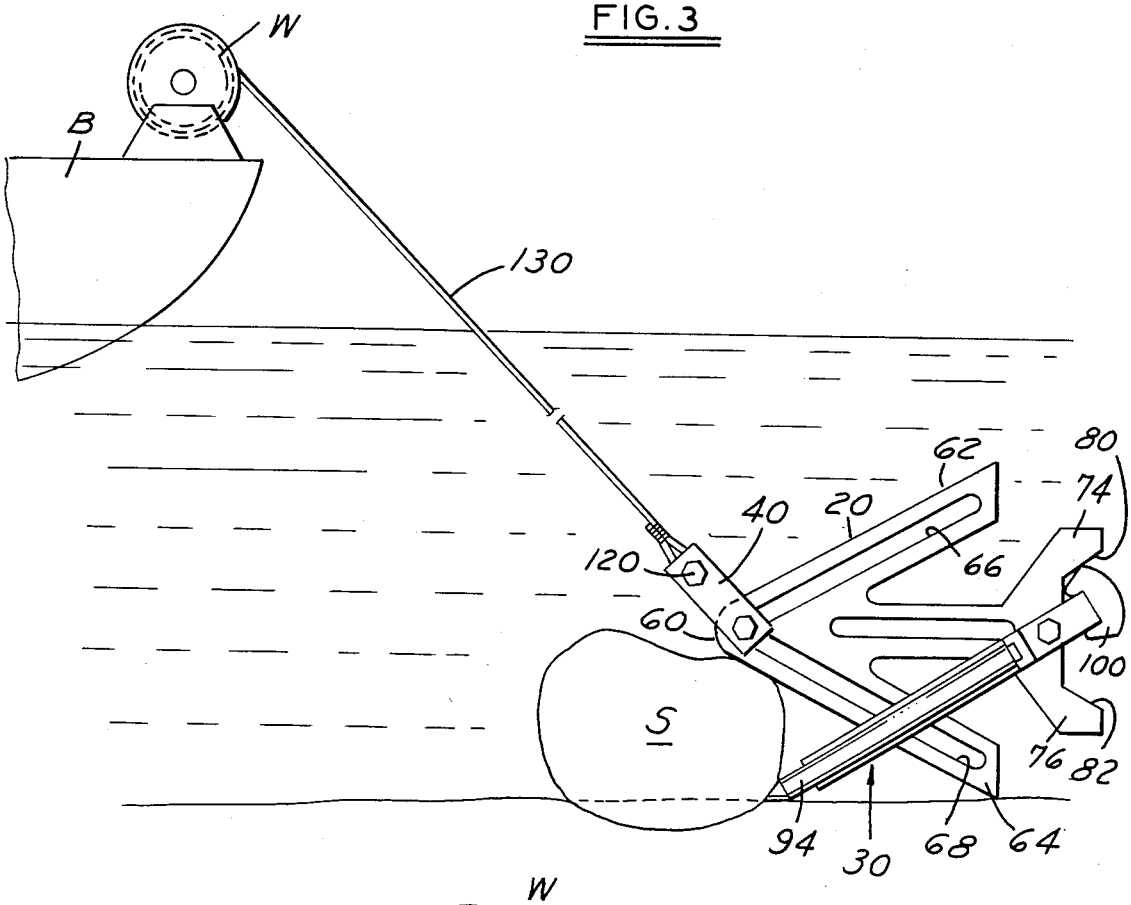
FIG. 3, a view of the anchor and a boat in holding position.

In FIG. 1, the anchor is shown with the blade lodged under a stone S. Similarly in FIG. 3, the blade is lodged under a stone S. The line or cable 130 is connected to a power winch W mounted on the prow of a boat B. In FIG. 3, the anchor has been lowered and dragged along the bottom until the blade 30 has caught on a stone or some other obstruction on the lake bottom.

It is desirable that an anchor line have an overall length about three times the depth in which a water craft is to be anchored.

Figure 4:
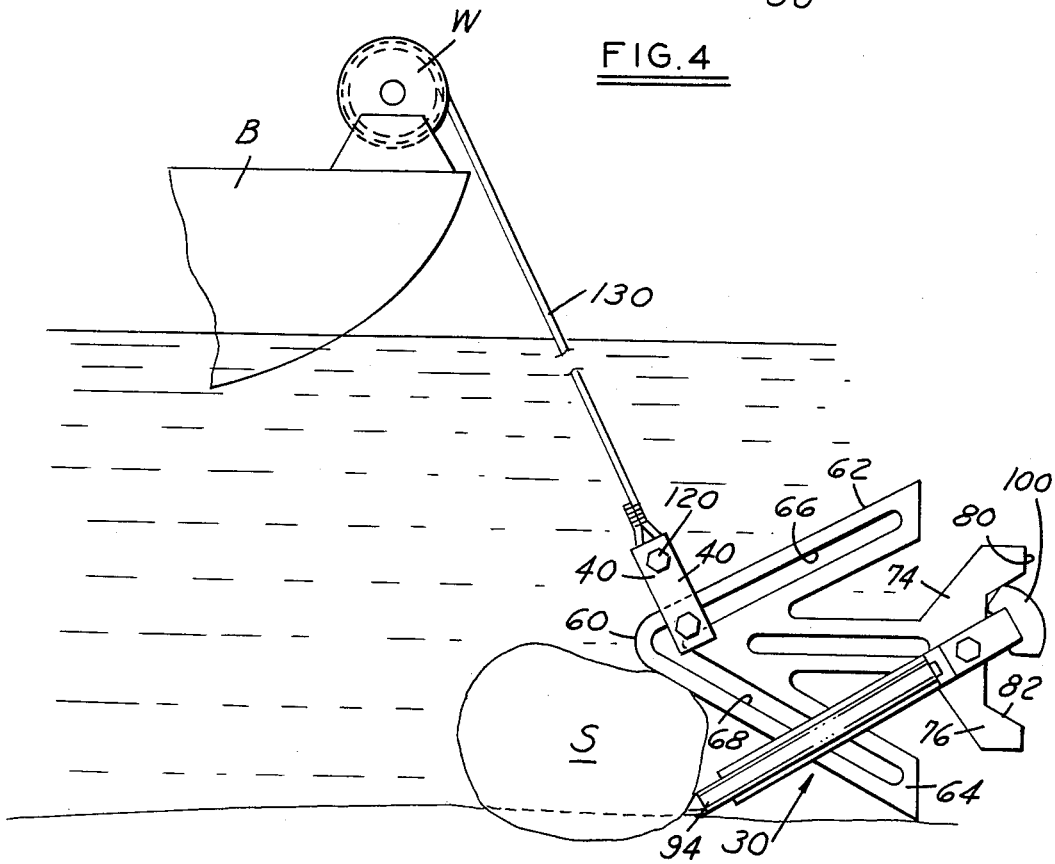
Figure 5:
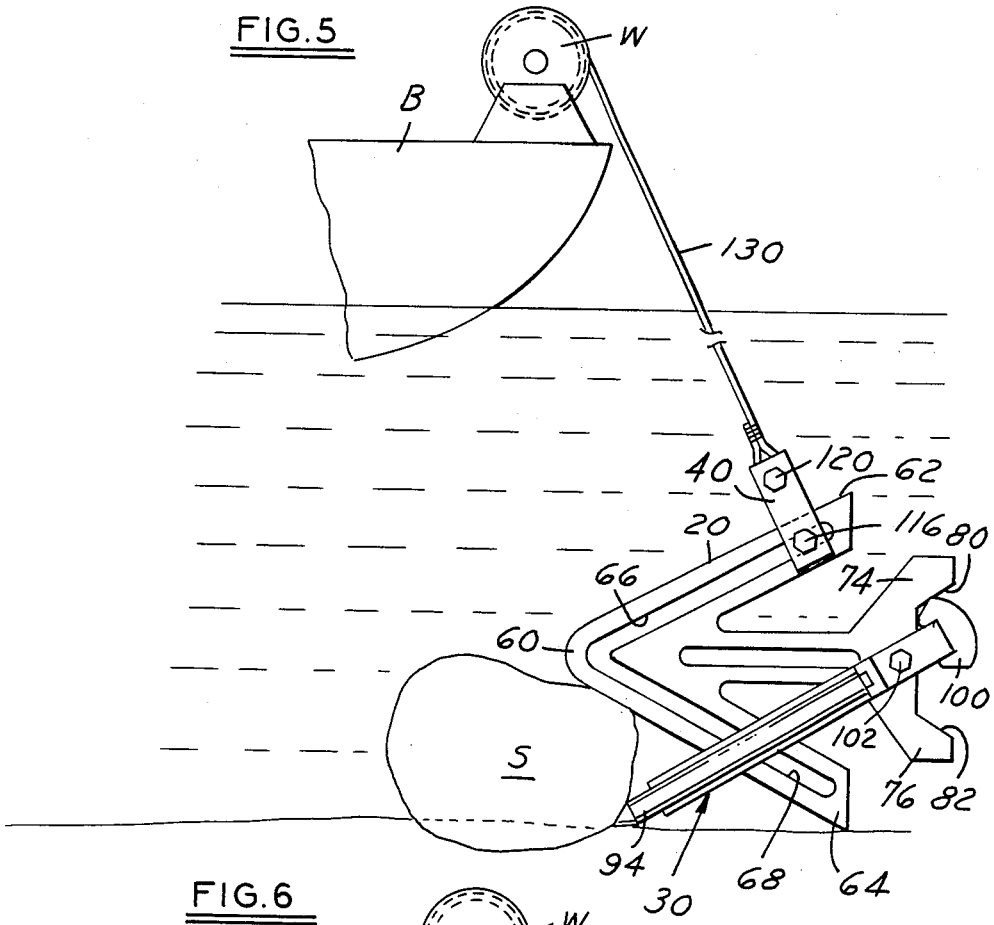
FIG. 5, a view of the anchor with a shackle progression to a release position.
Figure 6:
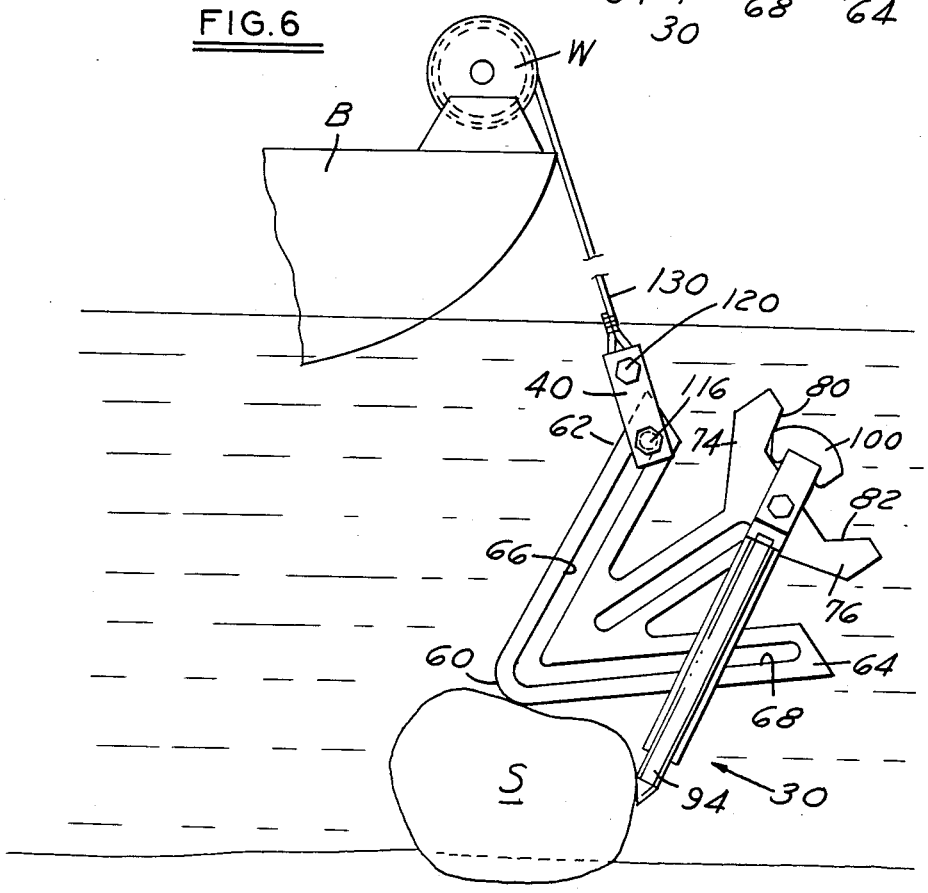
FIG. 6, a view of the anchor in a release position.

When it is desired to release the anchor, the power winch is actuated. It will be noted that the anchor position is governed by the stop lobe 100 acting against the stop extension 80. Thus, the relationship of the center plate 20 and the anchor blade is established. When the anchor line 130 is drawn in by the power winch W, the boat is pulled in the water closer to the anchor location. This is illustrated in FIG. 4. As the boat approaches the anchor point, the clevis 40, because of the increasing vertical component, starts climbing the slot 66. In FIG. 5, the clevis has reached the top of the slot. Further cable tension causes the entire assembly to pivot counterclockwise, thereby pulling the anchor blade upwardly and out of the lodged position under the stone or obstruction S.

Accordingly, it will be seen that it is not necessary to power the boat and move it to the right side of the obstruction to obtain release of the anchor. The spaced stop extensions 80 and 82 allow the anchor to fall on either side and the stop lobe will limit and control the angular relationship of the center plate and blade. The blade is thus positioned to plow into the lobe bottom or under an obstruction to reach a holding position.

I claim:

1. An anchor combination to achieve cable tension release which comprises:

(a) a center plate having a closed V-shaped slot with legs disposed at a predetermined angle to a first axis, with the bight of the V extending in a first direction, (b) a tail portion on said center plate extending on said first axis in a direction opposite said first direction and having spaced stop extensions on either side of said first axis, (c) an anchor blade pivoted on said tail portion adjacent said stop extensions having a stop lobe to cooperate with said stop extensions to limit the pivoting of said anchor blade and said center plate relative to each other, (d) a traveling bolt extending through said V-shaped slot, (e) a slide member affixed at one end to said bolt to slide with said bolt selectively along one of said legs of said V-slot, and (f) means to fasten said slide member at the other end to an anchor cable.

2. An anchor combination as defined in claim 1 in which said center plate has a V-shaped configuration paralleling said slot with a nose portion at the bight of said slot, and said tail portion extends outwardly from said center plate beyond the digital end of said slot legs.

3. An anchor combination as defined in claim 1 in which said V-slot and said center plate have respective legs and sides disposed at about 30° to said first axis.

* * * * *